United States Patent [19]

Jessop et al.

[11] 4,356,044

[45] Oct. 26, 1982

[54] EMULSION EXPLOSIVES CONTAINING HIGH CONCENTRATIONS OF CALCIUM NITRATE

[75] Inventors: Harvey A. Jessop, Lehi; Albert G. Funk, Salt Lake City, both of Utah

[73] Assignee: IRECO Chemicals, Salt Lake City, Utah

[21] Appl. No.: 246,763

[22] Filed: Mar. 23, 1981

[51] Int. Cl.[3] ..... C06B 45/00

[52] U.S. Cl. ..... 149/2; 149/21; 149/41; 149/60; 149/61

[58] Field of Search ..... 149/2, 21, 41, 60, 61

[56] References Cited

U.S. PATENT DOCUMENTS 4,141,767 2/1979 Sudweeks ..... 149/2

4,216,040 8/1980 Sudweeks ..... 149/43

*Primary Examiner*—Stephen J. Lechert, Jr.

[57] ABSTRACT

The invention relates to a water-in-oil emulsion blasting agent having a discontinuous aqueous oxidizer salt solution phase which contains a calcium nitrate to ammonium nitrate weight ratio of 1.5 or greater, a continuous oil or water-immiscible liquid organic phase, an emulsifier, and optionally a density reducing agent.

10 Claims, No Drawings

EMULSION EXPLOSIVES CONTAINING HIGH CONCENTRATIONS OF CALCIUM NITRATE

Emulsion slurry explosives generally are classifiable either as "Class A" explosives or as "Blasting Agents" under the hazardous materials regulations of the United States Department of Transportation (49 C.F.R. Subchapter C). Cap-sensitive explosives are classified as "Class A", and noncap-sensitve explosives generally are classified as a "Blasting Agent. " Where cap-sensitivity is not required for field applications, it is preferable to obtain a "Blasting Agent" classification because the transportation and storage requirements are less stringent; however, the required tests for a "Blasting Agent" classification are rigorous. See 43 C.F.R. 173.114a.

A need exists in the field for a small diameter, 75mm or less, water-in-oil emulsion blasting agent classifiable as a "Blasting Agent." It has been difficult to produce small diameter emulsion slurry explosives (those detonable in 75mm charge diameters or less) that will pass the U.S. DOT Blasting Agent tests and yet remain reliabily detonable in such small diameters. For example, the prior art discloses noncapsensitive emulsion blasting agents which contain AN as the primary or sole oxidizing agent. These prior art blasting agents generally would fail the Blasting Agent tests due primarily to the high amount of AN present. The present invention overcomes this problem by providing a water-in-oil emulsion slurry blasting agent that will reliably detonate in small diameters, but yet will pass the U.S. DOT Blsting Agent tests. This property also enhances reliability of detonation in larger diameters as well. Thus the compositions of the present invention are useful in both small and large diameters. The high CN content of the compositions also makes them particularly advantageous for use in areas of the world where CN is more plentiful and thus more economical than AN.

SUMMARY OF THE INVENTION

The invention comprises a noncap-sensitive water-in-oil emulsion blasting agent having a water-immiscible liquid organic fuel as a continuous phase; an emulsified aqueous inorganic oxidizer salt solution as a discontinuous phase, which salt solution contains a calcium nitrate to ammonium nitrate weight ratio of 1.5 or greater; an emulsifier; and optionally a density reducing agent.

DETAILED DESCRIPTION OF THE INVENTION

The present invention is based on the use of CN as the principal oxidizer salt in a weight ratio of AN of 1.5 or greater. It is found that emulsion slurry blasting agents containing this relatively high amount of CN to AN have properties that conventional emulsion slurry explosives, those containing more AN than CN or solely AN, do not. Specifically, one property is that the high-CN emulsion blasting agents of the present invention can have much smaller critical diameters but yet pass the U.S. DOT Blasting Agent tests. This result will be shown in the examples that follow. Thus, if AN is present as the principal oxidizer salt, emulsion explosives that have small critical diameters, and even those with relatively large critical diameters, generally are too sensitive to pass the Blasting Agent tests. If CN is the principal oxidizer, the emulsion blasting agents are less sensitive and more likely to pass the tests. This effect of CN is dramatic and of important commericial significance.

Most CN used in commercial blasting agents is fertilizer grade having about 15% by weight water of crystallization and about 6% AN. The amounts and percentages of CN referred to herein and in the appended claims are in reference to anhydrous CN. Thus if fertilizer grade CN is used, the amounts and percentages must be adjusted accordingly.

The CN is present in an amount by weight equal to or greater than 1.5 times the amount of AN present. Thus, the weight ratio of CN to AN is 1.5 or greater. Preferably, the percentage of CN is from about 50% to about 70% by weight based on the total composition. Correspondigly, the percentage of AN preferably is from 10% to about 33% by weight. Minor amounts may be added of additional oxidizer salts selected from the group consisting of ammonium, alkali and alkaline earth metal nitrates, chlorates and perchlorates. The amount of total oxidizer salt employed is generally from about 45% to about 90% by weight of the total composition and preferably from about 60% to about 86%.

The use of high amounts of CN does not by itself insure that the blasting agent will pass the Blasting Agent tests. Sensitivity also depends upon other factors such as the amount of water present, the type of liquid organic fuel(s) used, the density of the blasting agent, the presence and type of sensitizer, and the amount and type of emulsifier. For example, as is well-known, the sensitivity of a blasting agent can be increased by adding a sensitizer, such as fine aluminum particles, by adjusting water content, or by lowering the density by the addition of density reducing agents such as fine, hollow glass spheres. Nevertheless, it is observed that as the CN:AN ratio is increased, and the other parameters and ingredients essentially are held constant, the blasting agent will tend to remain noncap-sensitive even as the critical diameter correspondingly is decreased to relatively small diameters.

Water is employed in an amount from about 5% to about 20% by weight, based on the total composition. It is preferably employed in amounts of from about 10% to about 16%. Water-miscible organic liquids can partially replace water as a solvent for the salts, and such liquids also function as a fuel for the composition. Moreover, certain organic liquids reduce the crystallization temperature of the oxidizer salts in solution. Miscible liquid fuels can include alcohols such as methyl alcohol, glycols such as ethylene glycols, amides such as formamide, and analogous nitrogen-containing liquids. As is well known in the art, the amount of total liquid used can vary according to the desired physical properties.

The immiscible liquid organic fuel forming the continuous phase of the composition is present in an amount of from about 3% to about 10%, and preferably in an amount of from about 4% to about 8%. The actual amount used can be varied depending upon the particular immiscible fuel(s) used and upon the presence of other fuels, if any. When the immiscible fuel(s) is used as the sole fuel(s), it is preferably used in amount of from about 4% to about 8% by weight. The immiscible organic fuels can be aliphatic, alicyclic, and/or aromatic and can be saturated and/or unsaturated, so long as they are liquid at the formulation temperature. Preferred fuels include mineral oil, waxes, paraffin oils, benzene, toluene, xylenes, and mixtures of liquid hydrocarbons generally referred to as petroleum distillates such as gasoline, kerosene and diesel fuels. Particularly preferred liquid fuels are mineral oil, No. 2 fuel oil, paraffin waxes, and mixtures thereof. Aliphatic and aromatic nitrocompounds also can be used. Mixtures of any of the above and other fuels can be used.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed above. These additional solid and/or liquid fuels can be added generally in amounts ranging up to 15% by weight. If desired, undissolved oxidizer salt can be added to the composition along with any solid or liquid fuels.

The emulsifier of the present invention can be selected from those conventionally employed, and various types are listed in the abovereferenced patents. The emulsifier is employed in an amount of from about 0.2% to about 5% by weight. It preferably is employed in an amount of from about 1% to about 3%. Typical emulsifiers include sorbitan fatty acid esters, glycol esters, substituted oxazolines, alkyl amines or their salts, derivatives thereof and the like. Preferably the emulsifier contains an unsaturated hydrocarbon chain as its lipophilic portion, although the saturated form also can be used.

The compositions of the present invention preferably are reduced from their natural densities primarily by addition of a density reducing agent in an amount sufficient to reduce the density to within the range of from about 1.0 to about 1,4 g/cc. For example, gas bubbles can be entrained into the composition during mechanical mixing of the various ingredients or can be introduced by a chemical means such as a small amount (0.01 % to about 0.2% or more) of a gassing agent such as sodium nitrite, which decomposes chemically in the composition to produce gas bubbles. Small hollow particles such as plastic or glass spheres and perlite can be added.

One of the main advantages of a water-in-oil explosive over a continuous aqueous phase slurry is that thickening and cross-linking agents are not necessary for stability and water resistancy. However, such agents can be added if desired. The aqueous solution of the composition can be rendered viscous by the addition of one or more thickening agents and cross-linking agents of the type and in the amount commonly employed in the art.

The compositions of the present invention may be formulated by first dissolving the oxidizer salt(s) in the water (or aqueous solution of water and miscible liquid fuel) at an elevated temperature of from about 25° C. to about 90° C., depending upon the crystallization temperature of the salt solution. The emulsifier and the immiscible liquid organic fuel than are added to the aqueous solution, preferably at the same elevated temperature as the salt solution, and the resulting mixture is stirred with sufficient vigor to invert the phases and produce an emulsion of the aqueous solution in a continuous liquid hydrocarbon fuel phase. Usually this can be accomplished essentially instantaneously with rapid stirring. (The compositions also can be prepared by adding the aqueous solution to the liquid organic.) Stirring should be continued until the formulation is uniform. Solid ingredients if any are then added and stirred throughout the formulation. The formulation process also can be accomplished in a continuous manner.

It has been found to be particularly advantageous to predissolve the emulsifier in the liquid organic fuel prior to adding the organic fuel to the aqueous solution. Preferably, the fuel and predissolved emulsifier are added to the aqueous solution at about the temperature of the solution. This method allows the emulsion to form quickly and with minimum agitation.

Sensitivity and stability of the compositions may be improved slightly by passing them through a high-shear system to break the dispersed phase into even smaller droplets prior to adding the density control agent.

In further illustration of the invention, the Table contains formulations and detonation results of preferred compositions (Examples A–D) of the present invention.

The examples clearly show the advantage of using a high CN content for making Blasting Agents having small critical diameters. The examples show that the higher the CN content, the lower the critical diameter that can be attained in a composition without making the composition overly sensitive to shock. Example A has the lowest density (which is inversely proportional to sensitivity), but because of the high content of CN, it is classifiable as a Blasting Agent and will detonate reliably even in diameters as small as 25 mm. Examples B and C have similar properties to Example A.

A comparison of Examples D and E further illustrates the effect of CN. At essentially equivalent densities of 1.14 and 1.15 g/cc, Examples D and E, respectively, illustrate the dramatic effect of using higher amounts of CN. Example D contains only slightly more CN but is classifiable as a Blasting Agent whereas Example E, which contains less CN, is not. Example E is a Blasting Agent, however, at the higher density of 1.20. Examples F–H do not meet the required CN:AN ratio of greater than 1.5. Example F is not classifiable as a Blasting Agent at a density of 1.24 and becomes so only at a density of 1.28 and a larger critical diameter (32 mm). Example G is not classifiable as a Blasting Agent even at a density of 1.36 and a higher critical diameter of 38 mm. Example H is not classifiable as a Blasting Agent even though it has a critical diameter of 100 mm or more. In certain compositions, if the AN content is too high, a High Explosives classification cannot be avoided even at the natural density (using no density reducing agent) and though the critical diameter may be as high as 125 mm.

The compositions of the present invention can be used in the conventional manner. Although they normally are packaged, such as in cylindrical sausage form, in relatively small diameters, the compositions also can be loaded directly into boreholes as a bulk product. Thus the compositions can be used both as a small diameter and a large diameter product. The compositions generally are extrudable and/or pumpable with conventional equipment. The above-described properties of the compositions render them versatile and economically advantageous for most applications.

While the present invention has been described with reference to certain illustrative examples and preferred embodiments, various modifications will be apparent to those skilled in the art and any such modifications are intended to be within the scope of the invention as set forth in the appended claims.

TABLE

| COMPOSITION INGREDIENTS | A | B | C | D | E | F | G | H |
|---|---|---|---|---|---|---|---|---|
| (Parts by weight) | | | | | | | | |
| CN | 65 | 57 | 55 | 51 | 47 | 40 | 32 | 29 |
| AN | 5 | 15 | 20 | 25 | 30 | 39 | 49 | 53 |
| $H_2O$ (total) | 20 | 19 | 16 | 15 | 14 | 13 | 11 | 10 |
| Emulsifier[a] | 2 | 2 | 2 | 2 | 2 | 2 | 2 | 2 |
| Liquid Organic[b] | 8 | 8 | 8 | 7 | 7 | 6 | 6 | 6 |
| Density Reducing Agent[c] | d | d | d | d | d | d | d | d |
| Density (g/cc) | 1.10 | 1.12 | 1.04/1.15 | 1.14 | 1.15/1.20 | 1.24/1.28 | 1.36/1.46 | 1.45 |
| Detonation Results (5° C.) | | | | | | | | |
| Critical Diameter (mm) | 25 | 25 | 25/32 | 25 | 25/25 | 25/32 | 38/50 | 100 |
| Minimum Booster[e] | 8g | 8g | 8g/8g | 8g | #12/8g | #12/8g | 8g/8g | 88 |
| DOT Classification (20° C.)[f] | BA | BA | BA/BA | BA | HE/BA | HE/BA | HE/BA | HE/HE |

KEY
[a]2-(8-heptadecenyl)-4, 4-bis(hydroxymethyl)-2-oxazoline
[b]Mineral Oil
[c]Hollow glass spheres from 3-M Company
[d]Amount that was necessary to reduce density to level indicated
[e]"8g" represents an 8 gram pentolite booster; "#12" indicates the lowest blasting cap number that produced a detonation.
[f]U.S. Dept. of Transportation classification: "BA" stands for Blasting Agent, indicating that little or no reaction occurred with a #8 cap at 20° C. "HE" stands for High Explosive, indicating that reaction or detonation occurred with a #8 cap at 20° C.

What is claimd is:

1. A water-in-oil emulsion blasting agent comprising a water-immiscible liquid organic fuel as a continuous phase; an emulsified aqueous inorganic oxidizer salt solution as a discontinuous phase, which salt solution contais calcium nitrate in the amount of from about 50% to about 70% by weight based on the total composition and has a calcium nitrate to ammonium nitrate weight ratio of 1.5 or greater; an emulsifier; and optionally a density reducing agent.

2. An explosive composition according to claim 1 wherein the blasting agent is noncap-sensitve.

3. An explosive composition according to claim 1 wherein the salt solution contains ammonium nitrate in an amount of from 10% to about 33% by weight based on the total composition.

4. An explosive composition according to claim 1 wherein the emulsifier is selected from the group consisting of sorbitan fatty acid esters, glycol esters, substituted oxazolines, alkyl amines or their salts, and derivatives thereof.

5. An explosive composition according to claim 1 wherein the liquid organic fuel is selected from the group consisting of mineral oil, waxes, benzene, toluene, xylene, and petroleum distillates such as gasoline, kerosene, and diesel fuels.

6. An explosive composition according to claim 5 wherein the liquid organic fuel is mineral oil.

7. An explosive composition according to claim 1 wherein the density reducing agent is selected from the group consisting of small, hollow, dispersed glass or plastic spheres, perlite, a chemical foaming or gassing agent, and a combination of each.

8. An explosive composition according to claim 7 wherein the density reducing agent is small, hollow, dispersed glass spheres.

9. A noncap-sensitive water-in-oil emulsion blasting agent comprising from about 3% to about 10% by weight based on the total composition of a water-immiscible liquid organic fuel as a continuous phase; an emulsified aqueous inorganic oxidizer salt solution as a discontinuous phase, which salt solution comprises from about 50% to about 70% calcium nitrate, ammonium nitrate and from about 5% to about 20% water and in which the calcium nitrate to ammonium nitrate weight ratio is 1.5 or greater; from about 0.2% to about 5% of emulsifier, and a density reducing agent in an amount sufficient to reduce the density of the composition to within the range from about 1.0 to 1.4 g/cc.

10. An explosive composition according to claim 9 wherein the oxidizer salt solution contains from about 10% to about 33% ammonium nitrate by weight based on the total composition.

* * * * *